US010593499B2

(12) United States Patent
Murai

(10) Patent No.: US 10,593,499 B2
(45) Date of Patent: Mar. 17, 2020

(54) RELAY DRIVE CIRCUIT WITH A CURRENT MIRROR CIRCUIT

(71) Applicant: Onkyo Corporation, Osaka (JP)

(72) Inventor: Naofumi Murai, Osaka (JP)

(73) Assignee: Onkyo Corporation, Osaka (JP)

( * ) Notice: Subject to any disclaimer, the term of this patent is extended or adjusted under 35 U.S.C. 154(b) by 208 days.

(21) Appl. No.: 15/657,124

(22) Filed: Jul. 22, 2017

(65) Prior Publication Data

US 2018/0040445 A1 Feb. 8, 2018

(30) Foreign Application Priority Data

Aug. 4, 2016 (JP) ..... 2016-153719

(51) Int. Cl.
*H01H 47/32* (2006.01)
*H01H 47/02* (2006.01)

(52) U.S. Cl.
CPC ..... *H01H 47/325* (2013.01); *H01H 47/02* (2013.01); *H01H 47/32* (2013.01); *H01H 2047/025* (2013.01)

(58) Field of Classification Search
CPC ..... F01L 9/04; H01H 2047/025; H01H 47/00; H01H 47/001; H01H 47/02; H01H 47/32;
(Continued)

(56) References Cited

U.S. PATENT DOCUMENTS 4,510,550 A * 4/1985 Spires ..... H03K 17/64 330/257
5,245,523 A * 9/1993 Juzswik ..... H02H 7/0838 318/599

(Continued)

FOREIGN PATENT DOCUMENTS

JP 63-190225 A 8/1988
JP 63190225 U * 12/1988 ..... H01H 47/00

(Continued)

OTHER PUBLICATIONS

Japanese Office Action for corresponding App. No. 2016-153719, dated Oct. 23, 2018.

(Continued)

*Primary Examiner* — Thienvu V Tran
*Assistant Examiner* — Nicolas Bellido
(74) *Attorney, Agent, or Firm* — Renner, Otto, Boisselle & Sklar, LLP

(57) ABSTRACT

The present invention is intended to provide constant drive conditions of a relay switch. A relay drive circuit includes a current mirror circuit, a current suppression circuit 26, and a transistor Q3. The current mirror circuit includes a transistor Q1, a first resistor element R1, a transistor Q2, and a second resistor element R2. A relay coil 18 is provided on a current supply path extending from a collector terminal of the transistor Q1 to an earth conductor. The current suppression circuit 26 includes a capacitor C1 as a current suppression element configured to suppress, after conduction between an emitter terminal and a collector terminal of the transistor Q2 has been made, the current flowing through the current suppression element itself as compared to that in such conduction.

7 Claims, 4 Drawing Sheets

(58) Field of Classification Search
CPC ..... H01H 47/325; H03F 2203/45054; H03F 2203/45096; H03F 2203/45124; H03F 3/45; H03F 3/45174; H03F 3/45273; H03F 3/45372; H03F 3/4547; G05F 3/26; G05F 3/262; G05F 3/265; G05F 3/267
USPC ..... 361/152, 160, 189, 190; 330/257; 323/315
See application file for complete search history.

(56) References Cited

U.S. PATENT DOCUMENTS 5,412,309 A * 5/1995 Ueunten ..... G05F 3/267 323/303
5,610,486 A * 3/1997 Li ..... G05F 3/262 318/400.27
6,151,186 A * 11/2000 O'Farrell ..... G11B 5/5526 318/376
2005/0135040 A1* 6/2005 Suzuki ..... H01H 47/04 361/160
2006/0139839 A1* 6/2006 Sato ..... H01H 47/04 361/140
2007/0146959 A1* 6/2007 Morita ..... H01H 47/002 361/160
2014/0268473 A1* 9/2014 Hassan-Ali ..... H01H 47/02 361/179

FOREIGN PATENT DOCUMENTS

| | | | |
|---|---|---|---|
| JP | UM-01-001452 | A | 1/1989 |
| JP | 10-255627 | A | 9/1998 |
| JP | 11-224580 | A | 8/1999 |
| JP | 2000-241565 | A | 9/2000 |
| JP | 2005-268134 | A | 9/2005 |
| JP | 2007-200859 | | 8/2007 |
| JP | 2014-116197 | A | 6/2014 |
| JP | 2015-095432 | A | 5/2015 |
| JP | 2015-153555 | A | 8/2015 |

OTHER PUBLICATIONS

Extended European Search Report dated Jan. 3, 2018 for corresponding European Application No. EP 17182732.2.
Office Action dated May 22, for Japanese Patent Application No. 2016-153719 related to Japanese Patent Application No. 2007-200859 (English translation).

* cited by examiner

RELAY DRIVE CIRCUIT WITH A CURRENT MIRROR CIRCUIT

BACKGROUND OF THE INVENTION

1. Field of the Invention

The present invention relates to a relay drive circuit. Particularly, the present invention relates to a circuit configured to use semiconductor elements to drive a relay switch.

2. Description of the Related Art

Electric equipment using a relay switch has been broadly used. The relay switch includes, e.g., a relay switch with a relay coil and a movable piece. The relay coil operates as an electromagnet, and a current is applied to the relay coil such that the movable piece is attached to the relay coil. Moreover, the current flowing through the relay coil is blocked such that the movable piece is detached from the relay coil by a spring. When the movable piece is attached to the relay coil, a plurality of terminals provided at the relay switch are electrically connected together by the movable piece. When the movable piece is detached from the relay coil, these terminals are electrically disconnected from each other.

As described above, the relay switch is turned on or off between the terminals according to the current flowing through the relay coil, and therefore, control using a transistor configured to supply or block the current is facilitated. Patent literatures (JP-A-2014-116197, JP-A-10-255627, JP-A-2015-153555, JP-A-2015-095432, JP-A-2005-268134, JP-A-11-224580, JP-UM-A-01-001452) each describe the technique of controlling a relay switch by means of a transistor.

SUMMARY OF THE INVENTION

A transistor circuit configured to control a relay switch includes, e.g., a transistor circuit configured to apply a predetermined drive voltage to a relay coil to turn on a relay switch. However, attachment of a movable piece of the relay switch to the relay coil often depends on the current flowing through the relay coil. For this reason, when a resistance value of the relay coil changes due to, e.g., a temperature change caused by heat generation, the relay switch is not driven under the same conditions even with a constant drive voltage. This might lead to a variation in current consumption and operation timing, for example.

An object of the present invention is to provide constant drive conditions of a relay switch.

The present invention is a relay drive circuit including a current mirror circuit including a first semiconductor element and a second semiconductor element, the current mirror circuit being configured to adjust a current flowing through a first current path including the first semiconductor element according to a current flowing through a second current path including the second semiconductor element; and a control switch provided on the second current path. A relay coil is provided on the first current path.

Preferably, the relay drive circuit further includes a current suppression circuit provided on the second current path and configured to suppress, after conduction of the second semiconductor element has been made, the current flowing through the second current path as compared to that in conduction of the second semiconductor element.

Preferably, the current suppression circuit includes a current suppression element configured to suppress, after conduction of the second semiconductor element has been made, the current flowing through the current suppression element itself as compared to that in conduction of the second semiconductor element, and a current determination element configured to divide a current flow for the current suppression element and to determine the current flowing through the second current path.

Preferably, the current suppression circuit includes a capacitor and a current determination element configured to divide a current flow for the capacitor and to determine the current flowing through the second current path.

Preferably, the current suppression circuit includes a resistor element connected in series with the capacitor, and the current determination element is connected in parallel such that a current flow is divided for the capacitor and the resistor element connected in series.

Preferably, the current mirror circuit includes a first resistor element provided at a section of the first current path from a DC power supply to the first semiconductor element, and a second resistor element provided at a section of the second current path from the DC power supply to the second semiconductor element.

Preferably, a resistance value of the second resistor element is greater than a resistance value of the first resistor element.

According to the present invention, the constant drive conditions of the relay switch can be provided.

DETAILED DESCRIPTION OF THE PREFERRED EMBODIMENTS

Figure 1:
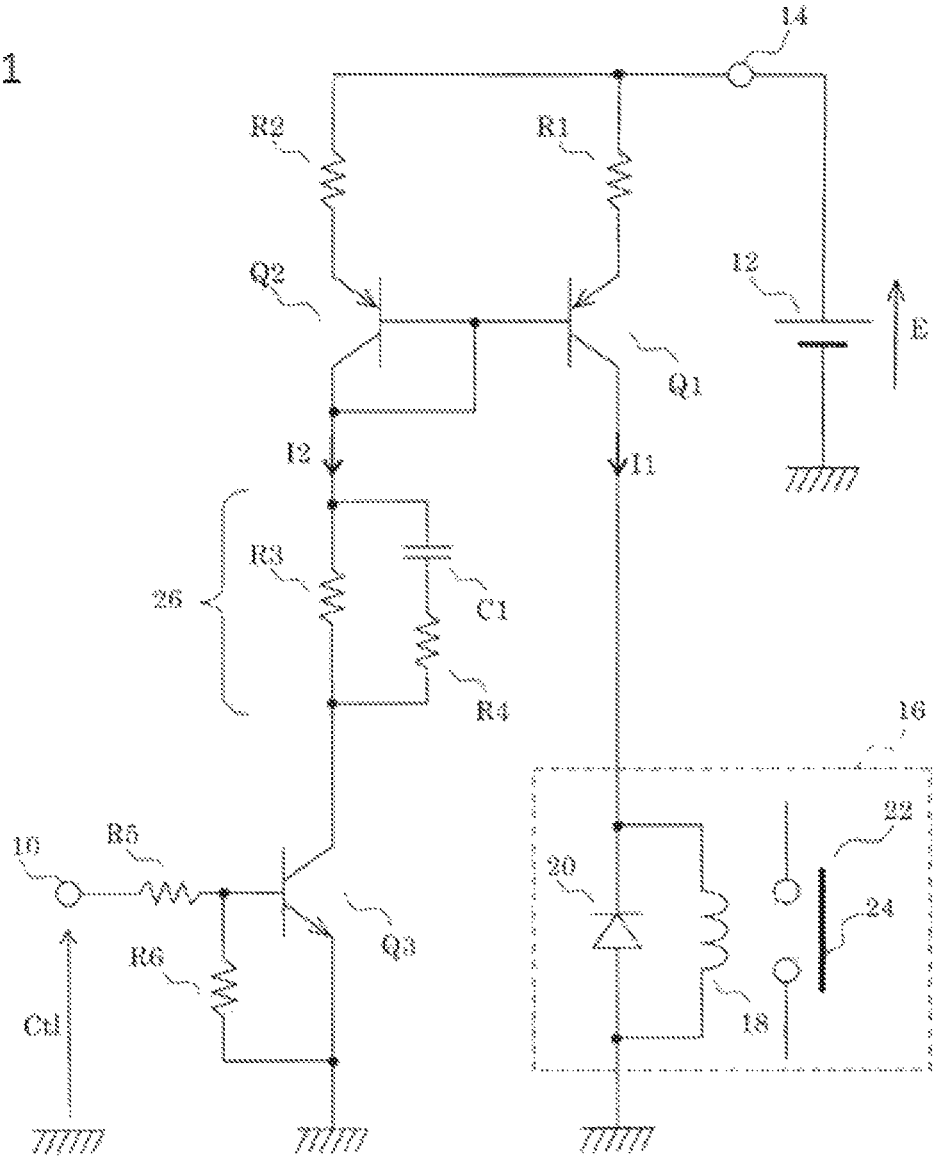
FIG. 1 is a diagram of a relay drive circuit.

FIG. 1 illustrates a relay drive circuit of an embodiment of the present invention. This relay drive circuit is configured such that a relay switch 16 is driven by a current mirror circuit including a PNP transistor Q1, a first resistor element R1, a PNP transistor Q2, and a second resistor element R2. The relay switch 16 is connected to a collector terminal of the transistor Q1, and is turned on/off according to the current flowing through the collector terminal of the transistor Q1.

A configuration of the relay drive circuit will be described. A fifth resistor element R5 is connected between a control terminal 10 and a base terminal of an NPN transistor Q3. A sixth resistor element R6 is connected between the base terminal and an emitter terminal of the transistor Q3. The emitter terminal of the transistor Q3 is connected to an earth conductor.

A collector terminal of the transistor Q3 is connected to one end of each of a third resistor element R3 and a fourth resistor element R4. The other end of the fourth resistor element R4 is connected to one end of a capacitor C1, and the fourth resistor element R4 and the capacitor C1 connected in series are connected respectively to both ends of the third resistor element R3.

A collector terminal of the transistor Q2 is connected to a connection end between the third resistor element R3 and the capacitor C1. A base terminal of the transistor Q2 is connected to the collector terminal of the transistor Q2 itself. The second resistor element R2 is connected between an emitter terminal of the transistor Q2 and a supply terminal 14.

The third resistor element R3, the fourth resistor element R4, and the capacitor C1 form a current suppression circuit 26, and as described later, are configured to suppress, as time advances, the current flowing through the collector terminal of the transistor Q2 after the transistors Q3, Q2 have been turned on.

The base terminal of the transistor Q2 and a base terminal of the transistor Q1 are connected as a common terminal. The first resistor element R1 is connected between an emitter terminal of the transistor Q1 and the supply terminal 14. The relay switch 16 is connected between the collector terminal of the transistor Q1 and the earth conductor.

The relay switch 16 includes a relay coil 18, a diode 20, and a switch 22. One end of the relay coil 18 is connected to the collector terminal of the transistor Q1, and the other end of the relay coil 18 is connected to the earth conductor. An anode terminal of the diode 20 is connected to the earth conductor, and a cathode terminal of the diode 20 is connected to the collector terminal of the transistor Q1. That is, the diode 20 is connected in parallel to the relay coil 18 with the anode terminal of the diode 20 facing an earth conductor side.

A positive side of a DC power supply 12 is connected to the supply terminal 14. A negative side of the DC power supply 12 is connected to the earth conductor.

Next, operation of the relay drive circuit will be described. In an initial state, the voltage of the control terminal 10 is zero, and the charge voltage of the capacitor C1 is zero. The transistors Q1 to Q3 are OFF. No current flows through the relay coil 18, and the relay switch 16 is OFF.

When a control voltage Ctl applied to the control terminal 10 reaches a high voltage from zero, a current flows from the base terminal to the transistor Q3 via the fifth resistor element R5, and the transistor Q3 is turned on. Thus, the transistor Q3 is turned on such that conduction is made between the collector terminal and the emitter terminal. Note that a current with a value obtained by dividing a voltage between the base terminal and the emitter terminal of the transistor Q3 by a resistance value R6 flows from the sixth resistor element R6 to the earth conductor.

Since the transistor Q3 is turned on, the voltage of turning on the transistor Q2 is applied to between the emitter terminal and the base terminal of the transistor Q2 via the second resistor element R2 and the current suppression circuit 26. With this configuration, conduction is made between the emitter terminal and the collector terminal of the transistor Q2.

When the transistor Q2 is turned on, the charge voltage of the capacitor C1 is zero, and the capacitor C1 is in a short circuit state. Thus, when the transistor Q2 is ON, the current suppression circuit 26 has a resistance value (R3//R4)=1/(1/R3+/R4) of the third resistor element R3 and the fourth resistor element R4 connected in parallel. Thus, initially when the transistor Q2 is turned on, an initial current I2*s* represented by (Expression 1) flows from the emitter terminal to the collector terminal of the transistor Q2, where a supply voltage output from the DC power supply 12 is E.

$$I2s = E/[R2 + (R3 // R4)] \quad \text{(Expression 1)}$$

$$= E/[R2 + R3 \cdot R4/(R3 + R4)]$$

After the transistor Q2 has been turned on, the capacitor C1 is charged according to the properties determined by each of resistance values R2, R3, R4 of the second resistor element R2, the third resistor element R3, and the fourth resistor element R4 and the electrostatic capacitance C1 of the capacitor C1, and the charge voltage of the capacitor C1 reaches the inter-terminal voltage of the third resistor element R3. With this configuration, the current flowing through the capacitor C1 and the fourth resistor element R4 reaches zero, and a current flows only through the third resistor element R3 of the circuit elements forming the current suppression circuit 26. The current I2*e* flowing from the emitter terminal to the collector terminal of the transistor Q2 after completion of charging of the capacitor C1 is the converging current I2*e* represented by (Expression 2). Note that the emitter-collector voltage of the transistor Q2 is sufficiently lower than the supply voltage E.

$$I2e=E/(R2+R3) \quad \text{(Expression 2)}$$

Figure 2:
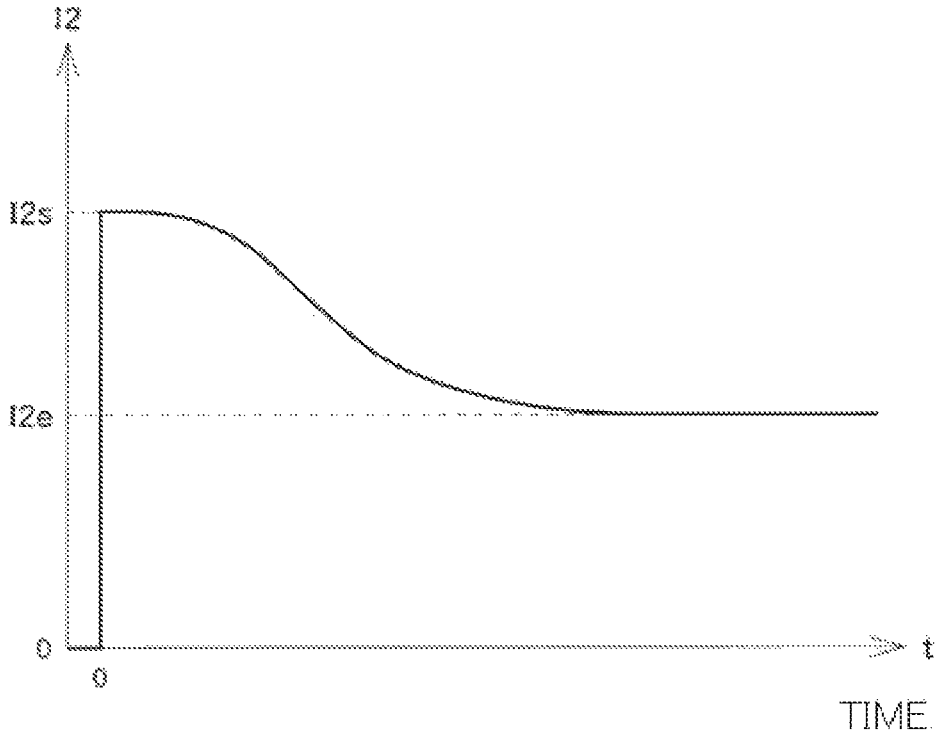
FIG. 2 is a graph of a relationship between a collector current I2 and a time.

FIG. 2 conceptually shows a relationship between the current (the collector current I2) flowing from the emitter terminal to the collector terminal of the transistor Q2 and a time t. When the time t=0, i.e., when the voltage of the control terminal 10 reaches the high voltage from zero and the transistor Q2 is turned on, the collector current I2 is the initial current I2*s*. Subsequently, the collector current I2 decreases according to the properties determined by each of the resistance values R2, R3, R4 of the second resistor element R2, the third resistor element R3, and the fourth resistor element R4 and the electrostatic capacitance C1 of the capacitor C1, and converges to the converging current I2*e*.

Next, operation of the current mirror circuit will be described. The current mirror circuit includes the transistor Q1, the first resistor element R1, the transistor Q2, and the second resistor element R2. The base terminal of the transistor Q2 is connected to the collector terminal of the transistor Q2 itself. The collector terminal of the transistor Q2 is connected to an upper end of the current suppression circuit 26, and therefore, the potential of the base terminal of the transistor Q2 is equal to the potential of the upper end of the current suppression circuit 26. Such a potential is also equal to the potential obtained by subtracting a voltage drop in the second resistor element R2 and the emitter-base voltage of the transistor Q2 from the supply voltage E.

In such a circuit configuration, when the collector current I2 increases, the emitter-base voltage of the transistor Q2 decreases, and the collector current I2 is brought into a decreasing state. Similarly, when the collector current I2 decreases, the emitter-base voltage of the transistor Q2 increases, and the collector current I2 is brought into an increasing state. That is, a negative feedback relationship is made between the emitter-base voltage of the transistor Q2 and the collector current I2. In the state in which an increase/decrease in the emitter-base voltage and an increase/decrease in the collector current I2 are balanced out, the emitter-base voltage and the collector current I2 are determined, and the potential of the base terminal is further determined.

The base terminal of the transistor Q1 is connected to the base terminal of the transistor Q2, and the first resistor element R1 is connected between the emitter terminal of the transistor Q1 and the supply terminal 14. The potential of the base terminal of the transistor Q1 is equal to the potential obtained by subtracting a voltage drop in the first resistor element R1 and the emitter-base voltage of the transistor Q1 from the supply voltage E. Moreover, the potential of the base terminal of the transistor Q1 is, by the base terminal of the transistor Q2, maintained at the potential depending on the collector current I2 of the transistor Q2. With such a circuit configuration, when the collector current I1 (the current flowing from the emitter terminal to the collector terminal of the transistor Q1) of the transistor Q1 increases, the emitter-base voltage of the transistor Q1 decreases, and the collector current I1 is brought into a decreasing state. Similarly, when the collector current I1 decreases, the emitter-base voltage of the transistor Q1 increases, and the collector current I1 is brought into an increasing state. That is, a negative feedback relationship is made between the emitter-base voltage of the transistor Q1 and the collector current I1. In the state in which an increase/decrease in the emitter-base voltage and an increase/decrease in the collector current I1 are balanced out, the emitter-base voltage and the collector current I1 are determined, and the potential of the base terminal is further determined.

As described above, (i) the potential of the base terminal of the transistor Q2 is determined in the state in which an increase/decrease in the emitter-base voltage of the transistor Q2 and an increase/decrease in the collector current I2 are balanced out, (ii) the potential of the base terminal of the transistor Q1 is determined in the state in which an increase/decrease in the emitter-base voltage of the transistor Q1 and an increase/decrease in the collector current I1 are balanced out, and (iii) the potentials of the base terminals of the transistors Q1, Q2 are equal to each other.

Thus, under the condition where the emitter-base voltages of the transistors Q1, Q2 are equal to each other or the condition where the emitter-base voltages of the transistors Q1, Q2 are sufficiently lower than any of the voltage drop in the first resistor element R1 and the voltage drop in the second resistor element R2, R1·I1=R2·I2 is satisfied. In this case, the collector current I1 is (R2/R1) times higher than the collector current I2, and (Expression 3) is satisfied.

$$I1=(R2/R1)\cdot I2 \quad \text{(Expression 3)}$$

Figure 3:
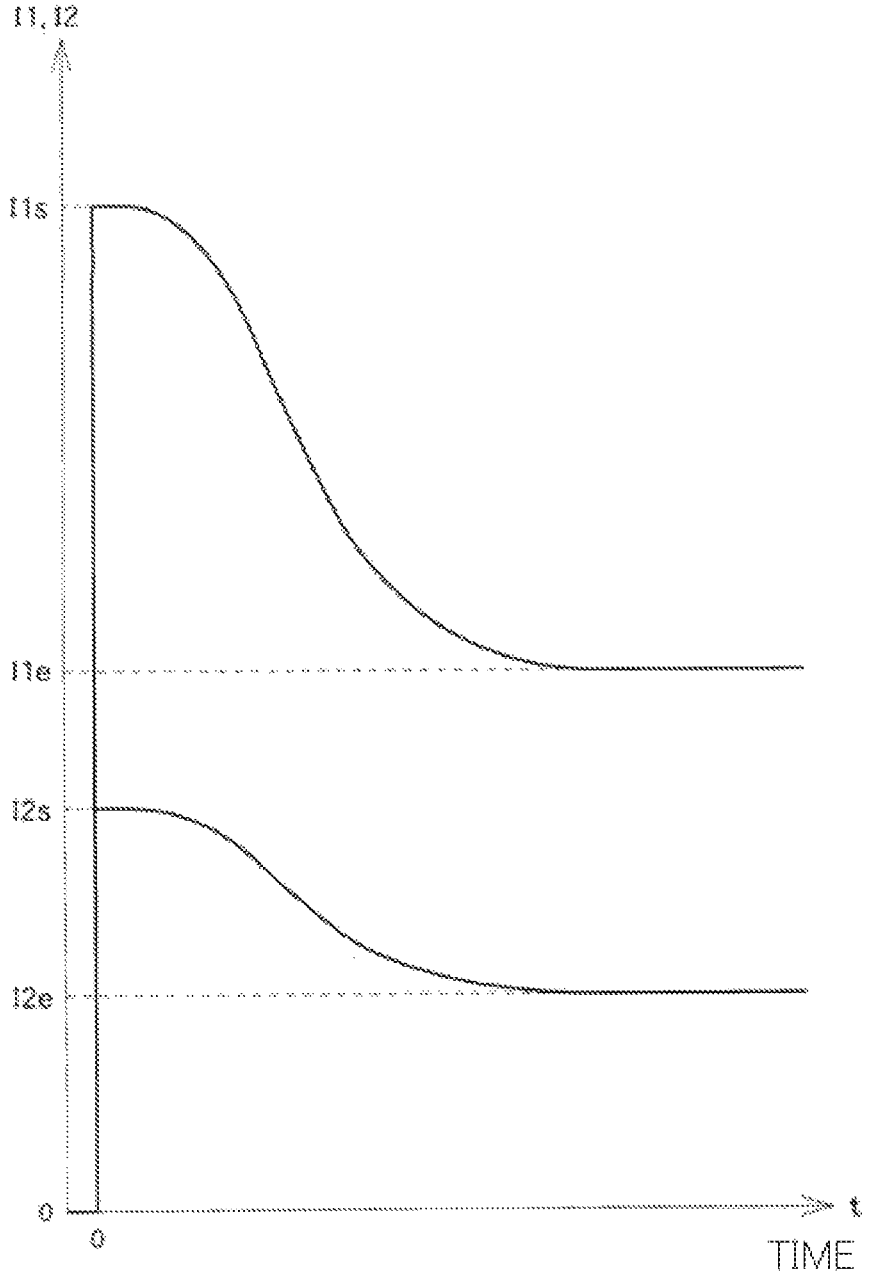
FIG. 3 is a graph of a relationship among the collector currents I1, I2 and the time.

FIG. 3 conceptually shows a relationship between the collector current I1 and the time t. When the time t=0, i.e., when the voltage of the control terminal 10 reaches the high voltage from zero and the transistors Q3, Q2 are turned on, the collector current I1 reaches the initial current I1*s* represented by (Expression 4).

$$\begin{aligned} I1s &= (R2/R1)\cdot I2s \quad \text{(Expression 4)} \\ &= (R2/R1)\cdot E/[R2+R3\cdot R4/(R3+R4)] \end{aligned}$$

Subsequently, the collector current I1 decreases according to the properties determined by each of the resistance values R2, R3, R4 of the second resistor element R2, the third resistor element R3, and the fourth resistor element R4 and the electrostatic capacitance C1 of the capacitor C1, and converges to the converging current I1*e* represented by (Expression 5).

$$\begin{aligned} I1e &= (R2/R1)\cdot I2e \quad \text{(Expression 5)} \\ &= (R2/R1)\cdot E/(R2+R3) \end{aligned}$$

FIG. 3 shows the collector current I2 in association with the collector current I1. In an example shown in this figure, the resistance value R2 of the second resistor element R2 is 2.5 times greater than the resistance value R1 of the first resistor element R1, and the collector current I1 is 2.5 times higher than the collector current I2.

The relay coil 18 is connected between the collector terminal of the transistor Q1 and the earth conductor, and the collector current I1 flows through the relay coil 18. The initial current I1*e* flows at the time at which the transistor Q1 is turned on, and the maximum current flows through the relay coil 18. This allows attachment of a movable piece 24 provided at the switch 22 to the relay coil 18, and the switch 22 is turned on. After the switch 22 has been turned on, the collector current I1 decreases, and converges to the converging current I1*e*. Thus, after the movable piece 24 has been attached to the relay coil 18, the current flowing through the relay coil 18 decreases, and converges to the converging current I1*e*.

Generally in a relay switch, a great current for moving a movable piece needs to be applied to a relay coil upon driving for attaching the movable piece to the relay coil. On the other hand, in a steady ON state after attachment of the movable piece to the relay coil, a current for maintaining an attachment state may flow through the relay coil.

According to the relay drive circuit of the present embodiment, the current flowing through the relay coil 18 is maximum upon driving, and decreases in the steady ON state. This reduces power consumption in the steady ON state, and suppresses heat generation of the relay coil 18.

By operation of the current mirror circuit, the properties of the collector current I1 in association with time passage are (R1/R2) times greater than the properties of the collector current I2. When a time until the collector current I1 converges from the initial current I1*s* to the converging current I1*e* is increased for reliable attachment of the movable piece 24 by the relay coil 18, a time until the collector current I2 converges from the initial current I2*s* to I2*e* may be increased. Such a time increases as the resistance value R3 of the third resistor element R3 or the electrostatic capacitance of the capacitor C1 increases.

In this state, as seen from (Expression 2) and (Expression 5), when the resistance value R3 increases, the converging current I2*e* and the converging current I1*e* decrease. Thus, there is a probability that a sufficient current for maintaining the attachment state of the movable piece 24 does not flow through the relay coil in the steady ON state.

For this reason, in the relay drive circuit of the present embodiment, each resistance value of the first resistor element R1 and the second resistor element R2 may be determined based on a relationship between the resistance value R3 of the third resistor element R3 and the converging current I2*e*. That is, a relationship of I2*e*=E/(R2+R3) is, as shown in (Expression 2), satisfied between the resistance value R3 and the converging current I2*e*, and therefore, the ratio R2/R1 of the resistance value R2 to the resistance value R1 may be increased by the reduction ratio of the converging current I2*e* in association with an increase in the resistance value R3. This allows a sufficient current to flow through the relay coil 18 in the steady ON state. Further, the electrostatic capacitance of the capacitor C1 is not necessarily increased for increasing the time until the initial current I1*s* converges to the converging current I1*e*, and the dimensions of the capacitor C1 can be reduced.

Moreover, in the relay drive circuit of the present embodiment, the current flowing through the relay coil 18 is determined by the collector current I1, and the collector current I1 is determined by the collector current I2. The collector current I2 is determined by the power voltage E, the resistance value R2 of the second resistor element R2, and the circuit constant of each element forming the current suppression circuit 26, and exhibits a low degree of dependence on a resistance value of the relay coil 18. Thus, the collector current I1 also exhibits a low degree of dependence on the resistance value of the relay coil 18, and the current mirror circuit operates as a constant current source for the relay coil 18. Thus, even when the resistance value of the relay coil 18 changes due to, e.g., a temperature change, the relay switch 16 is driven under constant conditions. Even with a variation in the resistance value of the relay coil 18 according to products, the operation conditions of the relay switch 16 of each product are constant.

Note that in the operation of turning off the relay switch 16, the control voltage Ctl applied to the control terminal 10 reaches zero from the high voltage. This turns off the transistor Q3, thereby blocking the collector current I2. Further, the collector current I1 is also blocked. With blocking of the collector current I1, dielectric electromotive force is generated at the relay coil 18 with the earth conductor side being the positive side, and the current tends to continuously flow through the relay coil 18. The current based on the dielectric electromotive force flows in a direction from the anode terminal to the cathode terminal in the diode 20, and flows back in a closed circuit including the diode 20 and the relay coil 18. Thus, such a current decreases due to a resistive component of the relay coil 18. Moreover, the transistors Q2, Q3 are turned off such that the capacitor C1 discharges a charge to the third resistor element R3 and the fourth resistor element R4.

As described above, the relay drive circuit of the present embodiment includes the current mirror circuit, the current suppression circuit 26, and the transistor Q3 as a control switch. The current mirror circuit includes the transistor Q1 (a first semiconductor element), the first resistor element R1, the transistor Q2 (a second semiconductor element), and the second resistor element R2. The relay coil 18 is provided on a current supply path extending from the collector terminal of the transistor Q1 to the earth conductor.

The current mirror circuit is configured to adjust the current flowing through a first current path formed by the first resistor element R1, the transistor Q1, and the relay coil 18 according to the current flowing through a second current path formed by the second resistor element R2, the transistor Q2, the current suppression circuit 26, and the control switch (the transistor Q3).

The current suppression circuit 26 includes the capacitor C1 as a current suppression element configured to suppress, after conduction between the emitter terminal and the collector terminal of the transistor Q2 has been made, the current flowing through the current suppression element itself as compared to that in such conduction. This current suppression element may be a switch or other capacitive elements, for example. In the case of using the switch as the current suppression element, e.g., a control circuit is provided, which is configured to be ON when the transistor Q3 is turned on and to be OFF when a predetermined time is elapsed after the control circuit has been turned on. Moreover, the current suppression circuit 26 includes the third resistor element R3 as a current determination element configured to divide a current flow for the current suppression element to supply such a current toward the transistor Q3 and to determine the current flowing through the second current path described above.

In addition to the third resistor element R3, a constant current diode may be used as the current determination element. In this case, an anode terminal of the constant current diode is connected to the collector terminal of the transistor Q2, and a cathode terminal of the constant current diode is connected to the collector terminal of the transistor Q3. In this case, the converging current I2*e* of the collector current I2 is defined by the constant current diode.

The circuit has been described above, in which the capacitor C1 and the fourth resistor element R4 are connected in series as the current suppression circuit 26 and the third resistor element R3 is connected in parallel to the capacitor C1 and the fourth resistor element R4 connected in series. The current suppression circuit 26 may be configured such that a portion corresponding to the fourth resistor element R4 is short-circuited instead of using the fourth resistor element R4. In this case, the initial collector current I2 and the initial collector current I1 are each represented by (Expression 1) and (Expression 4) where R4=0.

Figure 4:
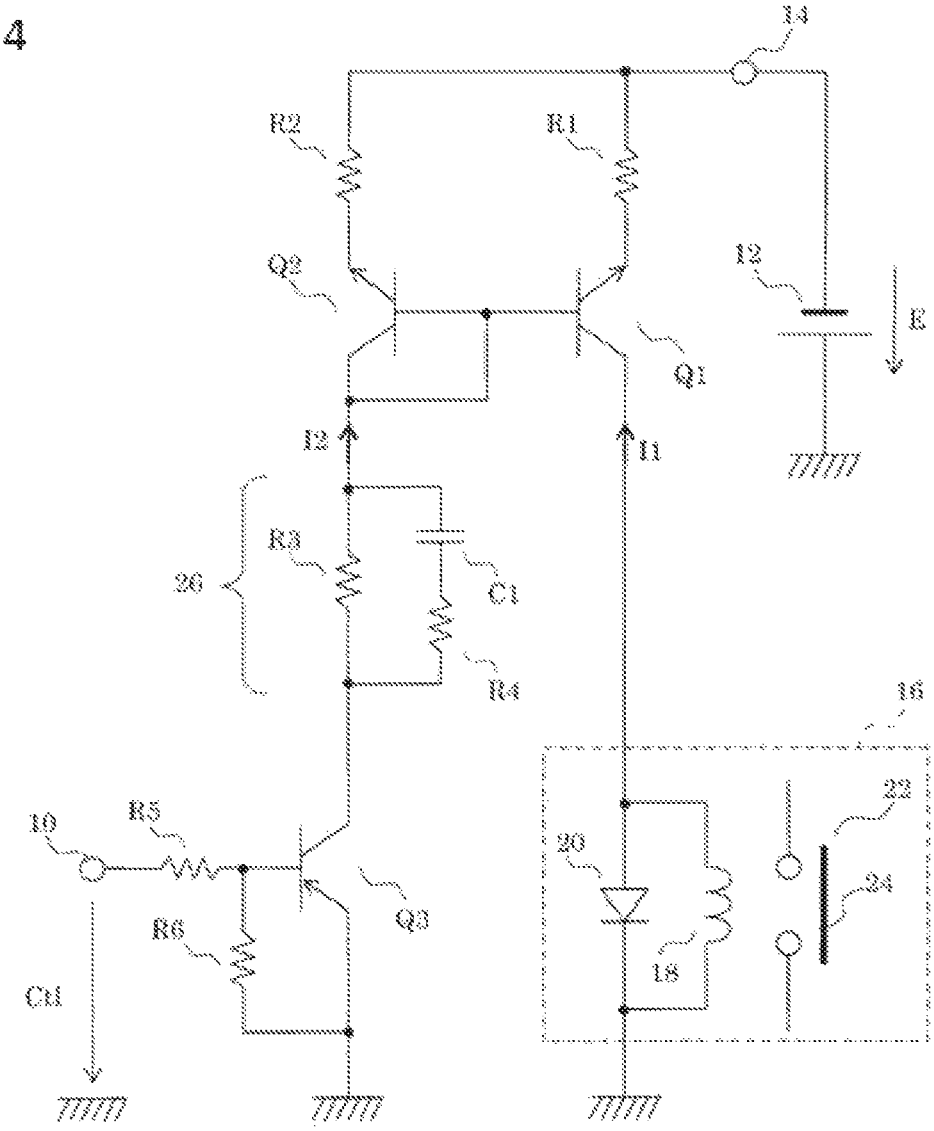
FIG. 4 is a diagram of the relay drive circuit.

The circuit configuration has been described above, in which the PNP transistors are used as the transistor Q1 and the transistor Q2 and the NPN transistor is used as the transistor Q3. In addition to such a circuit configuration, NPN transistors may be used as the transistor Q1 and the transistor Q2, and a PNP transistor may be used as the transistor Q3. In this case, the polarities of the DC power supply 12 and the diode 20 are inverted as illustrated in FIG. 4.

Moreover, the circuit configuration has been described above, in which the transistor configured to operate as the control switch, such as the transistor Q3, is provided between the current suppression circuit 26 and the earth conductor. Such a transistor as the control switch may be provided between the supply terminal 14 and the second resistor element R2, between the second resistor element R2 and the emitter terminal of the transistor Q2, or between the collector terminal of the transistor Q2 and the current suppression circuit 26.

Further, the circuit configuration has been described above, in which the PNP transistors are used as the transistor Q1 and the transistor Q2 and the NPN transistor is used as the transistor Q3. In addition to such a circuit configuration, N-channel field-effect transistors may be used as the transistor Q1 and the transistor Q2, and a P-channel field-effect transistor may be used as the transistor Q3. Alternatively, P-channel field-effect transistors may be used as the transistor Q1 and the transistor Q2, and an N-channel field-effect transistor may be used as the transistor Q3. In this case, a gate terminal, a drain terminal, and a source terminal are connected respectively to points connected to a base terminal, a collector terminal, and an emitter terminal of each transistor.

The relay switch 16 driven by the relay drive circuit of the present embodiment may be an audio power amplifier speaker relay switch. Generally, the speaker relay switch is provided on a path extending from a power transistor of a final stage to a speaker. ON-control of a speaker relay is, for example, performed after a power switch of an audio power amplifier has been turned on such that the audio power amplifier transitions from a transient state to a steady state. This avoids occurrence of great noise from the speaker when the power switch of the audio power amplifier is turned on.

In this case, a control signal for a change from zero to the high voltage is input to the control terminal 10 of the relay drive circuit of the present embodiment after a lapse of the time of transition of the audio power amplifier from the transient state to the steady state after the power switch of the audio power amplifier has been turned on. The relay drive circuit changes the voltage of the control terminal 10 to the high voltage, and turns on the speaker relay switch.

Moreover, when a short-circuit abnormality occurs at the speaker, an electrical burden on the power transistor might increase, and the life of the power transistor might be shortened. For this reason, the speaker relay may be controlled from ON to OFF when the current flowing through the power transistor exceeds a predetermined value. In this case, when the current flowing through the power transistor exceeds the predetermined value, a control signal for a change from the high voltage to zero is input to the control terminal 10 of the relay drive circuit of the present embodiment. The relay drive circuit changes the voltage of the control terminal 10 to zero, and turns off the speaker relay switch.

A DC power supply of the audio power amplifier includes, e.g., a DC power supply configured to rectify, after voltage lowering, the voltage of a commercial AC power supply to smooth the rectified voltage into a supply voltage by a capacitor without using a regulator IC. It might be difficult for such a DC power supply to drive the speaker relay with a constant current. According to the relay drive circuit of the present embodiment, even when the regulator IC is not used as the DC power supply, the speaker relay is driven with a constant current, and constant drive conditions are provided.

What is claimed is:

1. A relay drive circuit comprising:

a current mirror circuit including a first semiconductor element and a second semiconductor element, the current mirror circuit being configured to adjust a current flowing through a first current path including the first semiconductor element according to a current flowing through a second current path including the second semiconductor element;

a control switch provided on the second current path, and a current suppression circuit provided on the second current path and configured to suppress, after conduction of the second semiconductor element has been made, the current flowing through the second current path as compared to that in the conduction of the second semiconductor element, wherein the current suppression circuit includes a current suppression element configured to suppress, after the conduction of the second semiconductor element has been made, a current flowing through the current suppression element itself as compared to that in the conduction of the second semiconductor element, and a current determination element configured to divide the current flowing through the current suppression element and to determine the current flowing through the second current path, wherein a relay coil is provided on the first current path.

2. The relay drive circuit according to claim 1, wherein the current mirror circuit includes a first resistor element provided at a section of the first current path from a DC power supply to the first semiconductor element, and a second resistor element provided at a section of the second current path from the DC power supply to the second semiconductor element.

3. The relay drive circuit according to claim 2, wherein a resistance value of the second resistor element is greater than a resistance value of the first resistor element.

4. A relay drive circuit comprising:

a current mirror circuit including a first semiconductor element and a second semiconductor element, the current mirror circuit being configured to adjust a current flowing through a first current path including the first semiconductor element according to a current flowing through a second current path including the second semiconductor element;

a control switch provided on the second current path, and a current suppression circuit provided on the second current path and configured to suppress, after conduction of the second semiconductor element has been made, the current flowing through the second current path as compared to that in the conduction of the second semiconductor element, wherein the current suppression circuit includes a capacitor and a current determination element configured to divide a current flow for the capacitor and to determine the current flowing through the second current path, wherein a relay coil is provided on the first current path.

5. The relay drive circuit according to claim 4, wherein the current suppression circuit includes a resistor element connected in series with the capacitor, and the current determination element is connected in parallel such that a current flow is divided for the capacitor and the resistor element connected in series.

6. The relay drive circuit according to claim 4, wherein the current mirror circuit includes a first resistor element provided at a section of the first current path from a DC power supply to the first semiconductor element, and a second resistor element provided at a section of the second current path from the DC power supply to the second semiconductor element.

7. The relay drive circuit according to claim 6, wherein a resistance value of the second resistor element is greater than a resistance value of the first resistor element.

* * * * *